United States Patent [19]

Hashimoto et al.

[11] Patent Number: 5,006,895

[45] Date of Patent: Apr. 9, 1991

[54] ELECTROPHOTOGRAPHIC COPYING APPARATUS WITH BOOK MODE MAGNIFICATION CAPABILITY

[75] Inventors: Kaoru Hashimoto, Hyogo; Hiroyuki Ideyama, Osaka, both of Japan

[73] Assignee: Minolta Camera Kabushiki Kaisha, Osaka, Japan

[21] Appl. No.: 219,725

[22] Filed: Jul. 15, 1988

[30] Foreign Application Priority Data

Jul. 17, 1987 [JP] Japan ..... 62-179723

[51] Int. Cl.[5] ..... G03G 15/04; G03G 21/00

[52] U.S. Cl. ..... 355/243; 355/25; 355/311

[58] Field of Search ..... 355/200, 210, 243, 311, 355/25

[56] References Cited

U.S. PATENT DOCUMENTS

| | | | |
|---|---|---|---|
| 4,017,173 | 4/1977 | Komori et al. | 355/235 |
| 4,575,227 | 3/1986 | Ito et al. | 355/243 X |
| 4,666,289 | 5/1987 | Kawano | 355/243 |
| 4,682,877 | 7/1987 | Fujiwara et al. | 355/243 |
| 4,696,563 | 9/1987 | Shibusawa | 355/311 |
| 4,711,554 | 12/1987 | Nishimori | 355/214 |
| 4,743,946 | 5/1988 | Nishimori et al. | 355/25 X |
| 4,754,303 | 6/1988 | Ito | 355/311 X |
| 4,845,526 | 7/1989 | Ito | 355/243 X |

*Primary Examiner*—Fred L. Braun

*Attorney, Agent, or Firm*—Price, Gess & Ubell

[57] ABSTRACT

When a book copy mode is selected, a scanning system is set to a size corresponding to divided original areas. If an automatic paper selection function is being set, a size of paper used for copy is determined based on an input copying magnification and the thus set size for the scanning ssystem. Existence of paper of the determined size in a paper feed cassette is examined and if the paper exists, copy operation is performed. If it does not exist, a display of the paper size is caused to blink. In the book copying mode, the area size of one page of the book is manually designated by the operator, and this area designation parameter is used to set the projection magnification of the optical scanning system. On the other hand, if an automatic magnification selection function is being set, the copying magnification is determined based on an input paper size and the thus set size for the scanning system. Then, copy operation is performed by using the determined copying magnification.

16 Claims, 12 Drawing Sheets

ELECTROPHOTOGRAPHIC COPYING APPARATUS WITH BOOK MODE MAGNIFICATION CAPABILITY

BACKGROUND OF THE INVENTION

1. Field of the Invention

The present invention relates to an electrophotographic copying apparatus of a slit exposure type and particularly to a copying apparatus having a book copy mode in which an original to be scanned for exposure is divided into a first area and a second area and those two areas are scanned to successively form individual copy image planes.

2. Description of the Prior Art

In general, when a book copy mode is selected, a scanning system scans two facing pages of a book by dividing those pages into separate areas and a copy operation is continuously performed to copy each page on an individual copy plane. An example of the operation in the book copy mode is hereinafter described with reference to FIG. 1.

In order to copy specified two facing pages of a book, i.e., an even-numbered page A and an odd-numbered page B, the opened book is placed on a glass document platen 16 of a copying apparatus so that copy operation is performed in the book copy mode. The first scanning is performed by an odd-numbered page scanning $\alpha$ for the odd-numbered page B succeeding the even-numbered page A, i.e., the odd-numbered scanning o for the range from an original reference point b to an original end point c based on scanning from an original reference point a to the original end point c. Subsequently, an even-numbered page scanning $\beta$ for the even-numbered page A preceding the odd-numbered page B, i.e., the even-numbered page scanning $\beta$ for the range from the original reference point a to the original reference point b based on scanning from the original reference point a to the original reference point b is performed.

After the above described scanning operations, a copy image based on the even-numbered page scanning $\beta$ is excluded from a copy image based on the odd-numbered page scanning $\alpha$ so that the copy image of the odd-numbered page B is obtained. As a result, copies of the pages according to the page numbers of the document are obtained.

However, if the book copy mode is selected in such a copying apparatus, it is generally not possible to use a copy mode set by automatic detection of a size of an original such as an automatic magnification selection mode or an automatic paper selection mode. This is because in most apparatus the original size detecting function can be performed only in the case of using an original in the form of a sheet. Accordingly, if the book copy mode for a thick original such as a book is selected in such an apparatus, the apparatus is controlled so that a mode based on automatic detection of an original size as described above cannot be selected.

On the other hand, there is also a demand for copying an original with a desired magnification or a desired paper size even in the book copy mode.

However, under the circumstances, since the automatic magnification selection mode or the automatic paper selection mode cannot be used in the book copy mode, it is only possible to take measures such as limited selection of a specified paper size or magnification in the book copy mode. Such measures cannot satisfy the demands of the user and often cause errors such as a defective copy image.

SUMMARY OF THE INVENTION

An object of the present invention is to provide a copying apparatus which can be operated effectively in a book copy mode.

Another object of the present invention is to provide a copying apparatus capable of obtaining a copy of a desired magnification in the book copy mode.

A further object of the present invention is to provide a copying apparatus capable of obtaining a copy of a desired paper size in the book copy mode.

A still further object of the present invention is to provide a copying apparatus causing no error in copy operation in the book copy mode.

In order to accomplish the above described objects, a copying apparatus according to an aspect of the present invention comprises a document platen, optical scanning means, paper selection means, paper feed means, mode selection means, area designation means and image forming means. The document platen has an original placing area on which an original to be copied is placed. The optical scanning means scans the original on the document platen and projects an image thereof and it is capable of changing a projection magnification. The paper selection means selects a size of paper on which the image of the original is to be formed. The paper feed means includes a plurality of paper feed sections for storing paper sheets of different sizes and feeds a paper sheet of a size selected by the paper selection means from the corresponding one of the paper feed sections. The mode selection means selects either a normal mode or a division mode. In the normal mode, the image of the original on the original placing area is formed as it is on the paper sheet fed by the paper feed means. In the division mode, the original placing area is divided into two areas and images of the original on the divided areas are individually formed on the respective paper sheets fed by the paper feed means. The area designation means designates an area size defined by the division of the original placing area. The image forming means automatically calculates, in the division mode, the projection magnification to be set in the optical scanning means, based on the paper size selected by the paper selection means and the area size designated by the area designation means and executes image formation by using the calculated projection magnification.

In the copying apparatus thus constructed, an appropriate projection magnification is automatically calculated and image formation is executed based on this magnification. Accordingly, copy of a desired paper size can be obtained easily and reliably even in the book copy mode.

Further, in order to accomplish the above described objects, a copying apparatus according to another aspect of the present invention comprises a document platen, copying magnification designation means, optical scanning means, paper feed means, mode selection means, area designation means, paper size determination means and image forming means. The document platen has an original placing area on which an original to be copied is placed. The copying magnification designation means designates a copying magnification. The optical scanning means scans the original on the document platen and projects an image of the original according to the copying magnification designated by the copying magnification designation means. The paper feed means includes a plurality of paper feed sections for storing paper sheets of different sizes and feeds a paper sheet of a specified size from the corresponding one of the paper feed sections. The mode selection means selects either a normal mode or a division mode. In the normal mode, the image of the original on the original placing area is formed as it is on the paper sheet fed by the paper feed means. In the division mode, the original placing area is divided into two areas and images of the original on the divided areas are individually formed on the respective paper sheets fed by the paper feed means. The area designation means designates an area size defined by the division of the original placing area in the division mode. The paper size determination means automatically determines, in the division mode, a size of paper to be fed by the paper feed means based on the copying magnification designated by the copying magnification designation means and the area size designated by the area designation means. The image forming means executes image formation on the paper sheet fed from the paper feed means based on the determination of the paper size by the paper size determination means in the division mode.

In the copying apparatus thus constructed, an appropriate paper size is automatically determined and paper of the determined size is fed so that image formation is effected. Accordingly, copy of a desired copying magnification can be obtained easily and reliably even in the book copy mode.

Further, in order to accomplish the above described objects, a copying apparatus according to a further aspect of the invention comprises original placing means, scanning means, paper feed means, mode designation means, area designation means, paper size selection means, first image forming means, copying magnification designation means, second image forming means, and enabling means. The original placing means has an original placing area on which an original to be copied is placed. The scanning means scans the original on the original placing area and projects an image of the original according to a designated copying magnification. The paper feed means stores paper sheets of different sizes and feeds a paper sheet of a specified size. The mode designation means designates a division mode. In the division mode, the original placing area is divided into two areas and an image of the original on each divided area is formed on a paper sheet fed by the paper feed means. The area designation means designates an area size defined by the division of the original placing area. The paper size selection means selects a size of paper on which the image of the original is to be formed. The first image forming means determines the copying magnification based on the paper size selected by the paper size selection means and the area size designated by the area designation means and executes image formation with the determined copying magnification. The copying magnification designation means designates the copying magnification. The second image forming means determines a size of paper to be fed from the paper feed means based on the copying magnification designated by the copying magnification designation means and the area size designated by the area designation means and executes image formation with the determined paper size. The enabling means enables either the paper size selection means or the copying magnification designation means.

In the copying apparatus thus constructed, a desired copying magnification or a desired paper size can be designated and an appropriate paper size or an appropriate copying magnification can be automatically determined according to the designation, so that image formation is executed. Accordingly, desired copy can be obtained easily and reliably even in the book copy mode.

These objects and other objects, features, aspects and advantages of the present invention will become more apparent from the following detailed description of the present invention when taken in conjunction with the accompanying drawings.

DESCRIPTION OF THE PREFERRED EMBODIMENT

Figure 2:
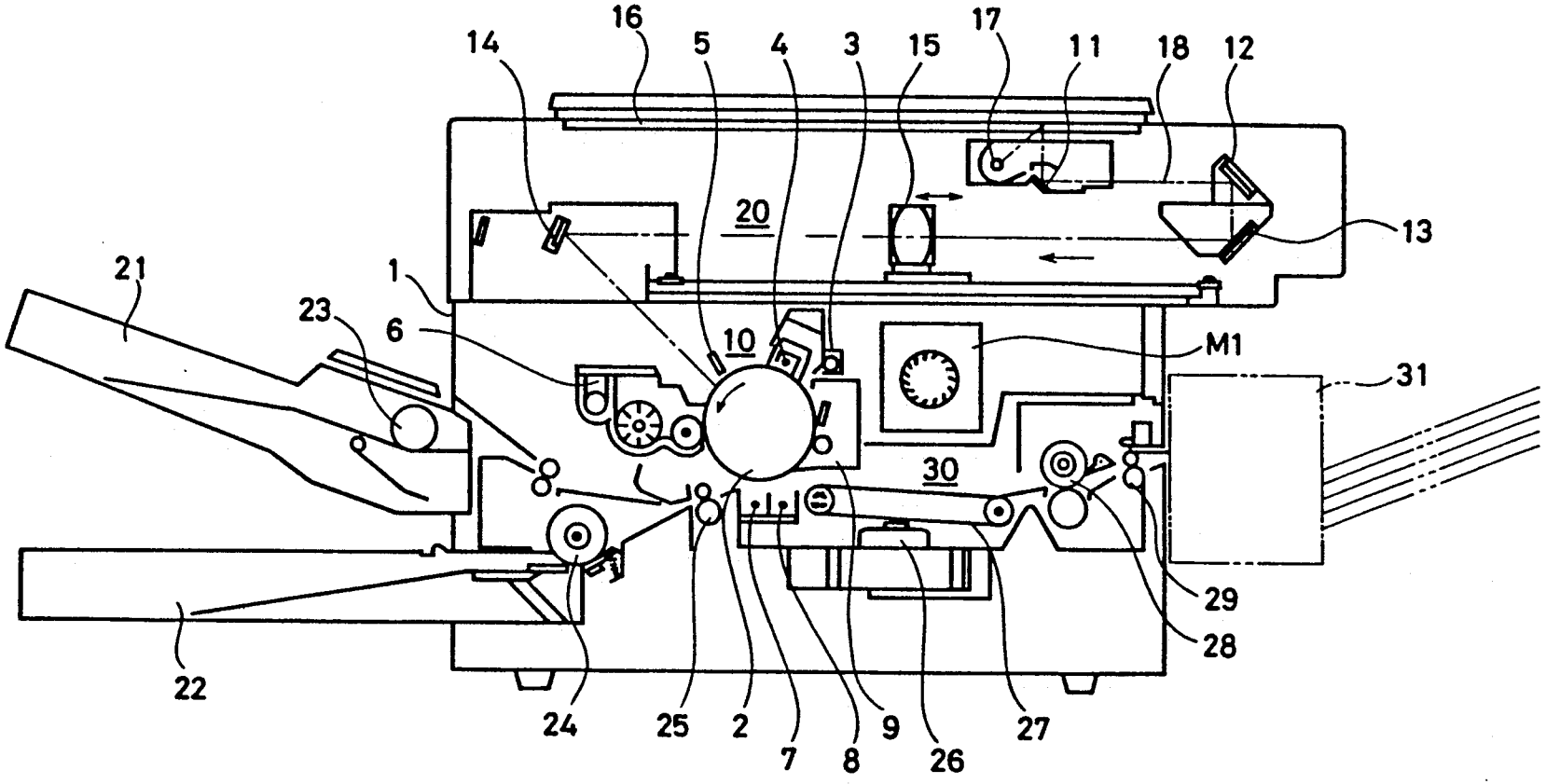
FIG. 2 is a schematic sectional view showing a construction of a copying apparatus according to an embodiment of the present invention.

FIG. 2 is a schematic sectional view showing a construction of a copying apparatus according to an embodiment of the present invention. Since the mechanical construction and the copy operation of the copying apparatus are well known and do not have a direct relation with the characteristic features of the present invention, a detailed description thereof is omitted.

Referring to FIG. 2, a photoconductor drum 2 rotatable counterclockwise is provided in a central portion of a main body 1 of the copying apparatus and there are provided, around the photoconductor drum 2, a main eraser 3, a corona charger 4, a side eraser 5 for specified area erasure, a developing device 6, a transfer charger 7, a separation charger 8, a cleaner 9 and the like in this order. The photoconductor drum 2 is for example a drum having a surface on which a photoconductor such as selenium is provided. This drum 2 receives light from a lamp of the main eraser 3 and is charged when it passes along the corona charger 4. Then, it is subjected to image exposure from a scanning system 20 to be described later. A latent image formed by the exposure is developed by the developing device 6 and the developed image is transferred onto copy paper by means of the transfer charger 7. The copy paper is separated from the drum by the separation charger 8 after image transfer. Residual toner on the photoconductor drum 2 after the transfer is removed by the cleaner 9 and residual charge on the photoconductor drum 2 is also removed by the main eraser 3 so that the subsequent copy process can be started. Thus, the process of erasure, charging, development, transfer, separation and erasure is repeated on the photoconductor drum 2.

The photoconductor drum 2, the main eraser 3, the corona charger 4, the side eraser 5 for specified area erasure, the developing device 6, the transfer charger 7, the separation charger 8, the cleaner 9 and the like constitute an image forming system 10.

The scanning system 20 is provided under a document platen 16 of glass to scan an original image. The scanning system 20 is driven by a scanner motor not shown. The scanning system 20 comprises a light source 17, a first mirror 11, a second mirror 12, a third mirror 13, a fourth mirror 14, and a projection lens 15. An original image is successively reflected on the first mirror 11, the second mirror 12, the third mirror 13 and the fourth mirror 14 and attains the photoconductor drum 2.

The projection lens 15 moves along an optical axis to set an arbitrary magnification. If the copying magnification is n, the light source 17 and the first mirror 11 move leftward in the drawing at a speed v/n where v is a constant rotating speed of the photoconductor drum 2, irrespective of whether the copying magnification n is an equal-scale magnification or a variable-scale magnification. At the same time, the second mirror 12 and the third mirror 13 moves leftward at a speed v/2n. As a result of the movement, exposure of the original image is applied onto the surface of the photoconductor drum 2 from the fourth mirror 14 in a slit manner.

An upper automatic feed cassette 21 and a lower automatic feed cassette 22 are attached to an upper paper feed opening and a lower paper feed opening, respectively, on a left side of the main body 1. Sizes of paper sheets in the automatic feed cassettes 21 and 22 are detected by paper size detection switches not shown.

Papers in the automatic feed cassette 21 or the automatic feed cassette 22 are selectively fed into the main body 1 of the copying apparatus through an upper feed roller 23 or a lower feed roller 24 and transported to a timing roller 25 in a pressed state, where it is held in standby.

The paper fed through the timing roller 25 comes to the position of the transfer charger 7, where a toner image is transferred onto the paper, and then the paper passes through the discharge rollers 29 and is discharged on a sorter 31 or a tray etc. not shown, outside the main body 1 of the copying apparatus.

The automatic feed cassette 21 or the automatic feed cassette 22, the feed roller 23 or the feed roller 24, the timing roller 25, a transport belt 27, a fixing device 28, the discharge rollers 29 and the like constitute a paper feed and discharge system 30.

The copying apparatus repeats the above described copy operation by the number of times corresponding to the number of copies set by the operator prior to the copy operation and after an elapse of a predetermined period, the operation of the copying apparatus is stopped.

A main motor M1 drives the photoconductor drum 2 of the image forming system 10, the paper feed and discharge system 30 and the like. Though not shown, the scanning system 20 is driven by the scanner motor, the projection lens 15 is driven by a magnification setting motor to change the copying magnification, and the developing device 6 is driven by a development motor.

Figure 3:
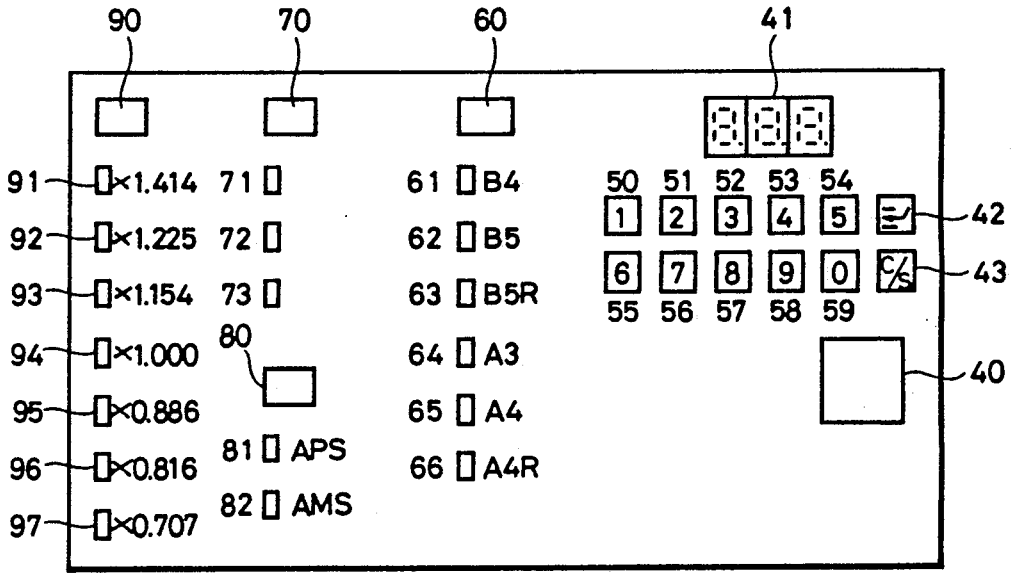
FIG. 3 is an enlarged plan view of an operation panel on an upper surface of a main body of the copying apparatus shown in FIG. 2.

FIG. 3 is an enlarged plan view of an operation panel on an upper surface of the main body.

Referring to FIG. 3, a print start key 40 is used to start copy operation and ten-keys 50 to 59 are used to set the number of copies and the copying magnification. An interruption key 42 is used to allow an interruption copy for other number of copies during copy operation for a predetermined number of copies. A clear stop key 43 is used to clear data displayed on a numerical display portion 41, that is, data entered by operation of the ten-keys 50 to 59 and the like.

A paper selection key 60 has a B4 display element 61, a B5 display element 62, a B5R display element 63, an A3 display element 64, an A4 display element 65 and an A4R display element 66 formed by LEDs, which are successively selected by the paper selection key 60 in a rotating manner to display a selected size of paper.

A copy mode selection key 70 is operated to display a selected copy mode in a rotating manner. The copy mode is displayed by any of a single-face copy display element 71, a duplex copy display element 72 and a composite copy display element 73 formed by LEDs.

An automatic mode selection key 80 is operated to display an automatic mode set in a rotating manner by an automatic paper selection (APS) display element 81 or an automatic magnification selection (AMS) display element 82 each formed by an LED. The APS display element 81 displays a mode for automatically selecting a paper size corresponding to an original size and a magnification. The AMS display element 82 displays a mode for automatically setting a magnification corresponding to an original size and a copy paper size. Each of the APS display element 81 and the AMS display element 82 is turned off by cancelling of the automatic mode, which means that a manual mode is set.

A magnification selection key 90 is operated to display a magnification designated in a rotating manner. The designated magnification is displayed by any of display elements 91 to 97 formed by LEDs. The 1.414 magnification display element 91 displays a setting of scale-up from an A4-size original to A3-size paper, from a B5-size original to B4-size paper or from an A5-size original to A4-size paper defined by movement of the projection lens 15. The 1.225 magnification display element 92 displays a setting of scale-up from an A5-size original to B5R-size paper or from an A4-size original to B4-size paper. The 1.154 magnification display element 93 displays a setting of scale-up from a B4-size original to A3-size paper or from a B5-size original to A4R-size paper.

The 1.000 magnification display element 94 displays an equal scale for copying an original image on paper, defined by movement of the projection lens 15.

The 0.866 magnification display element 95 displays a setting of scale-down from an A5-size original to B6-size paper, from an A4-size original to B5R-size paper or from an A3-size original to B4-size paper. The 0.816 magnification display element 96 displays a setting of scale-down from a B5-size original to A5-size paper or from a B4-size original to A4R-size paper. The 0.707 magnification display element 97 displays a setting of scale-down from an A3-size original to A4R-size paper, from a B4-size original to B5R-size paper, from an A4-size original to A5-size paper, from a B5-size original to B6-size paper or from an A5-size original to A5-size paper.

Figure 1:
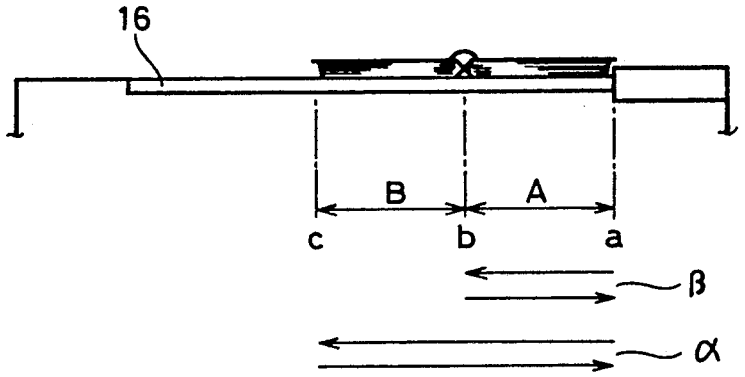
FIG. 1 is a schematic sectional view of an upper portion of a copying apparatus for explaining a generally used book copy mode.
Figure 4:
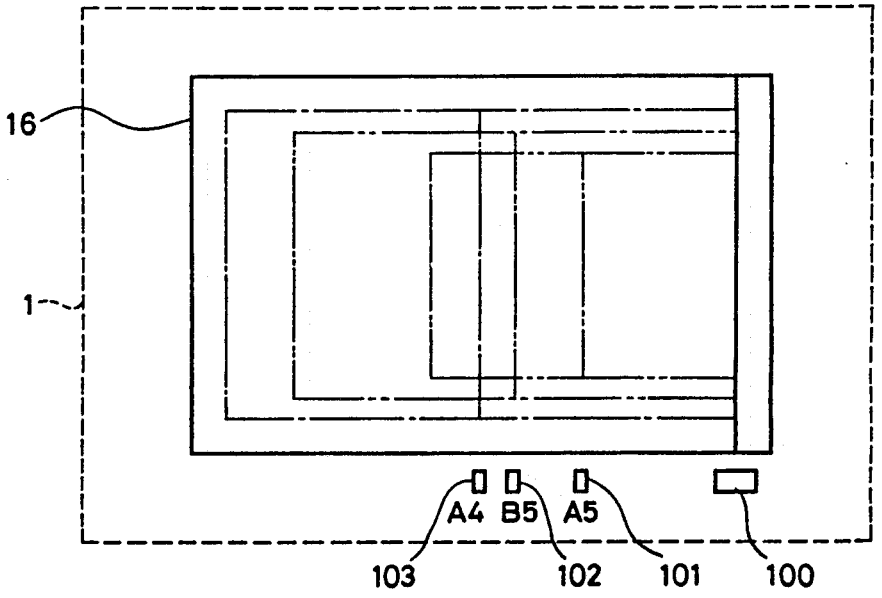
FIG. 4 is a top view of the main body of the copying apparatus showing original boundary display elements and the like in a book copy mode according to the embodiment of the present invention.

Further, as shown in a plan view of a main part of input means for selecting a book copy mode in FIG. 4, a book copy mode selection key 100 is operated to select, in a rotating manner, an A5-size original boundary display element 101, a B5-size original boundary display element 102 or an A4-size original boundary display element 103 provided along a longitudinal direction of the document platen of glass and to turn on the selected display element, thereby to display a set size for the original and a boundary position between two facing pages of the original to be placed on the document platen. Any of those display elements 101 to 103 is turned off by cancelling of the book copy mode. The above mentioned boundary position corresponds to the point b in FIG. 1.

Figure 5:
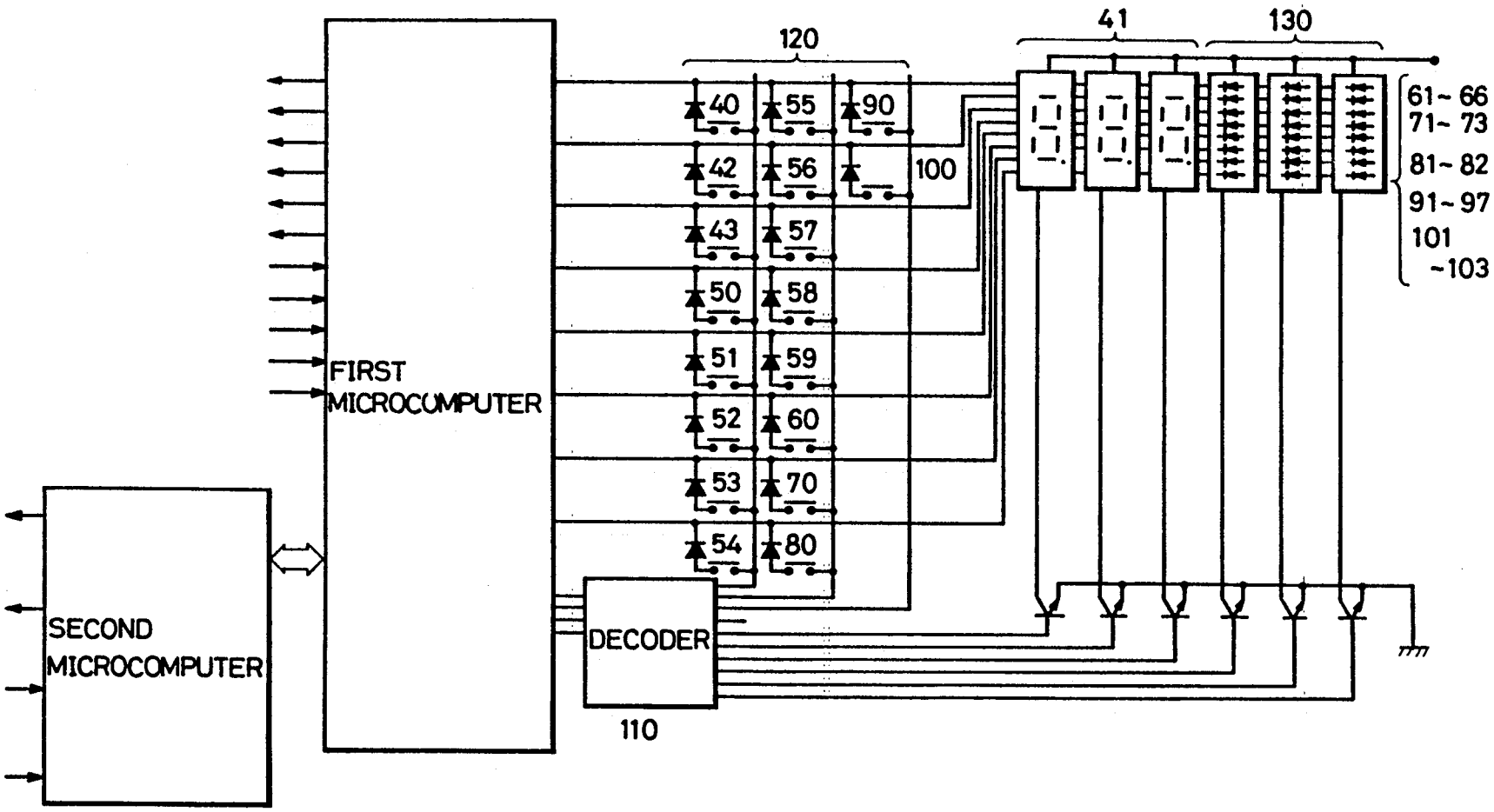
FIG. 5 is a circuit diagram showing a configuration of a control circuit of the copying apparatus in the embodiment of the present invention.

FIG. 5 is a circuit diagram of a control circuit to be used in the copying apparatus of the embodiment of the present invention.

Referring to FIG. 5, a first microcomputer functioning as a host computer is connected with a second microcomputer through an interruption terminal and data input/output terminals. The first microcomputer is connected to a key input matrix circuit 120 to be controlled through a decoder 110 and to an LED display group 130 for displaying various modes and the like.

Output ports of the first microcomputer are connected to the main motor M1, the development motor, a clutch of the timing roller, a clutch of the upper feed roller 23, a clutch of the lower feed roller 24, the main eraser 3, the corona charger 4, the side eraser 5, the transfer charger 7, the separation charger 8 and the like through drivers not shown. Input ports of the first microcomputer receive signals of various sensors, not shown, necessary for control of the image forming system 10 and the paper feed and discharge system 30. The second microcomputer is connected to the scanning system 20 such as the magnification setting motor and the scanner motor through drivers not shown. The second microcomputer receives signals of various sensors, not shown, necessary for the scanning.

As described above, the first microcomputer controls the image forming system 10 and the paper feed and discharge system 30 and enters data on display and key operation of the operation panel in response to input through the ten-keys or the sensors. The second microcomputer controls the scanner motor of the scanning system 20 and the magnification setting motor formed by a stepping motor or the like.

Figure 6:
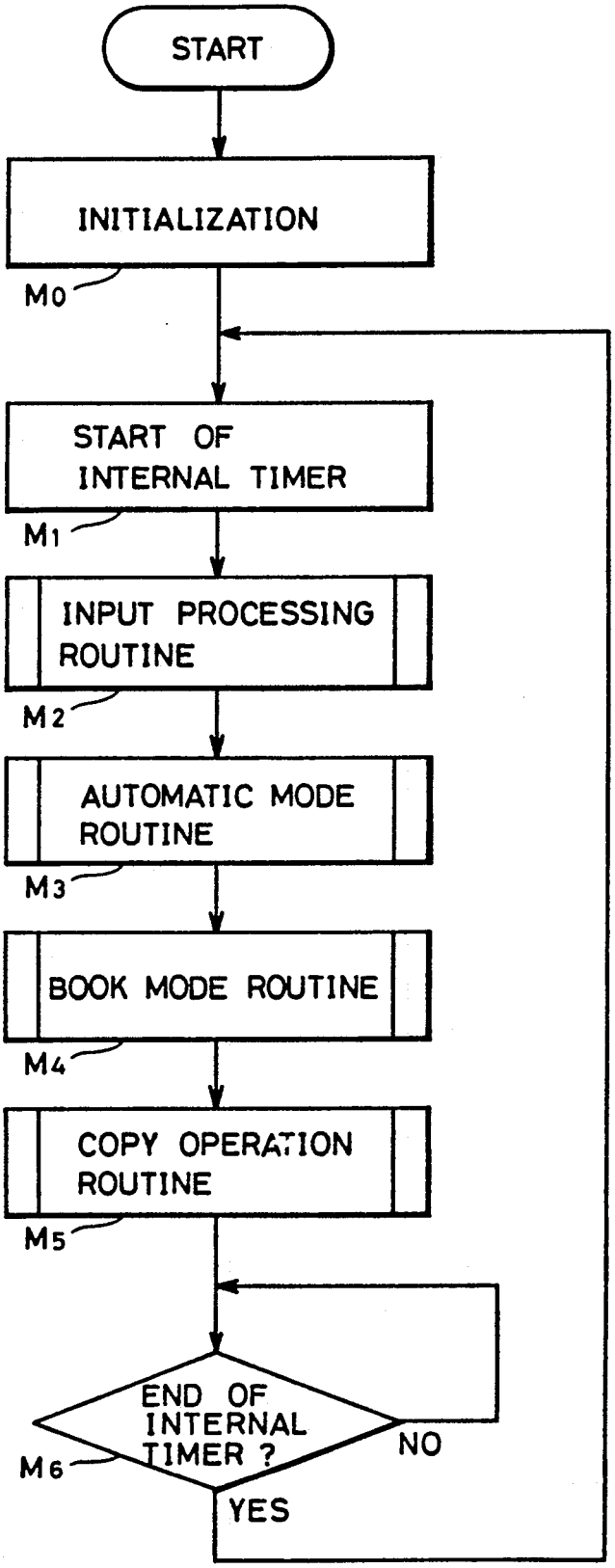
FIG. 6 is a flow chart of a main routine for controlling a first microcomputer shown in FIG. 5.

FIG. 6 is a flow chart of a main routine for controlling the first microcomputer as the host computer of the copying apparatus of the embodiment of the invention.

First, in the step M0, power supply is turned on and initialization is performed. In the step M1, an internal timer for defining a period of time required for one cycle of the main routine is started. Then, an input processing routine for entering input conditions is called in the step M2; an automatic mode routine is called in the step M3; a book mode routine is called in the step M4; a copy operation routine is called in the step M5; and in the step M6, at an end of the internal timer, one cycle of the main routine is completed.

Various timers used in the above mentioned routines perform counting operation based on the thus defined period of time of one cycle. In other words, an end of counting of each of those timers is determined dependent on the number of cycles executed. Since the input processing routine and the copy operation routine are well known and do not have a direct relation with the characteristic features of the invention, a description thereof is omitted.

Transmission of data from the first microcomputer as the host computer to the second microcomputer is effected based on an interruption request from the first microcomputer for processing of each of the above mentioned routines, independently of processing of the main routine.

Figure 7:
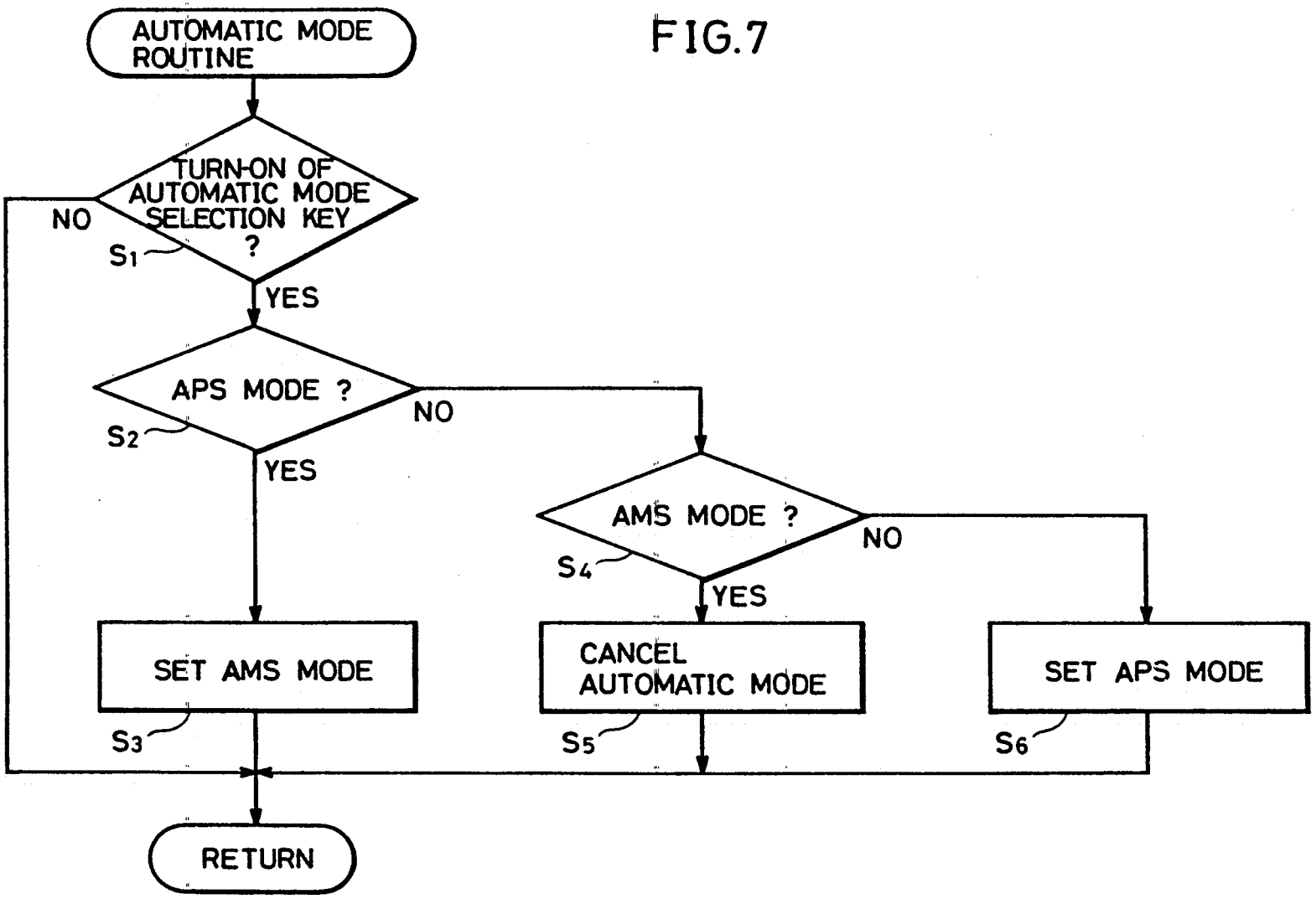
FIG. 7 is a flow chart showing details of an automatic mode routine included in the main routine of FIG. 6.

FIG. 7 is a flow chart showing details of the automatic mode routine in the step M3.

In this automatic mode routine, the automatic mode selection key 80 is operated to select a predetermined function in a rotating manner in the order of turn-on of the APS display element, turn-on of the AMS display element and cancelling of the automatic mode (which indicates setting of the manual mode with the APS and AMS display elements being turned off).

First, in the step S1, determination is made as to a turn-on of the automatic mode selection key 80 and if the turn-on of the automatic mode selection key 80 is not detected, the processing flow exits from this routine. If the turn-on of the automatic mode selection key 80 is detected, the below described processing is performed. When it is determined in the step S2 that the APS display element is turned on and that the automatic paper selection function is set, the APS display element is turned off in the step S3 and the AMS display element is turned on to set the automatic magnification selection function. If the APS display element is not turned on in the step S2, the step S4 is executed. When it is determined in the step S4 that the AMS display element is presently turned on and that the automatic magnification selection function is set, the AMS display element is turned off in the step S5 and thus both of the APS display element and the AMS display element are turned off, whereby the automatic mode is cancelled and the manual mode is set. On the other hand, if the AMS display element is not turned on in the step S4, the APS display element is turned on in the step S6 to set the automatic paper selection function.

Figure 8A:
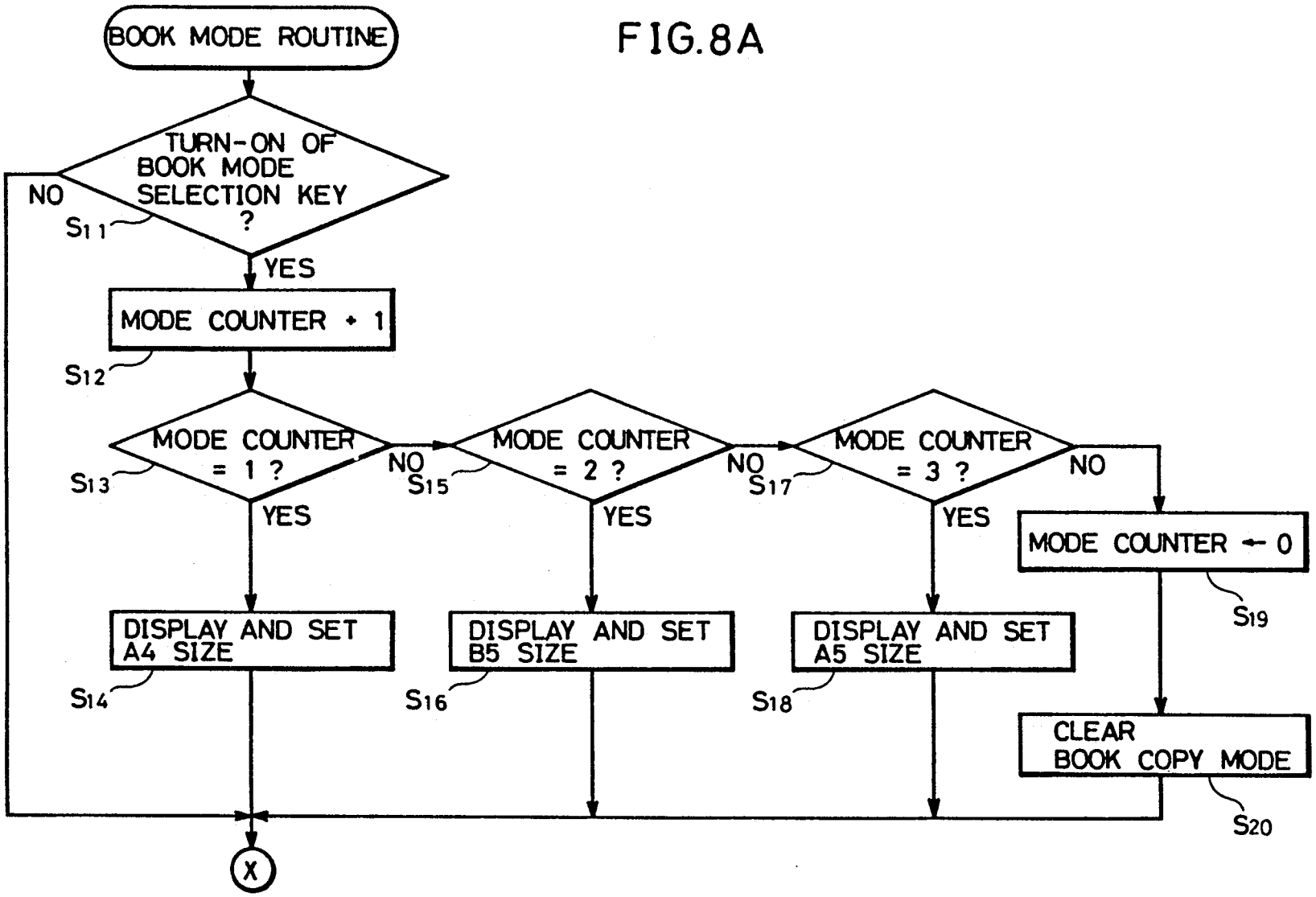
FIGS. 8A and 8B are flow charts showing details of a book mode routine included in the main routine in FIG. 6.
Figure 8B:
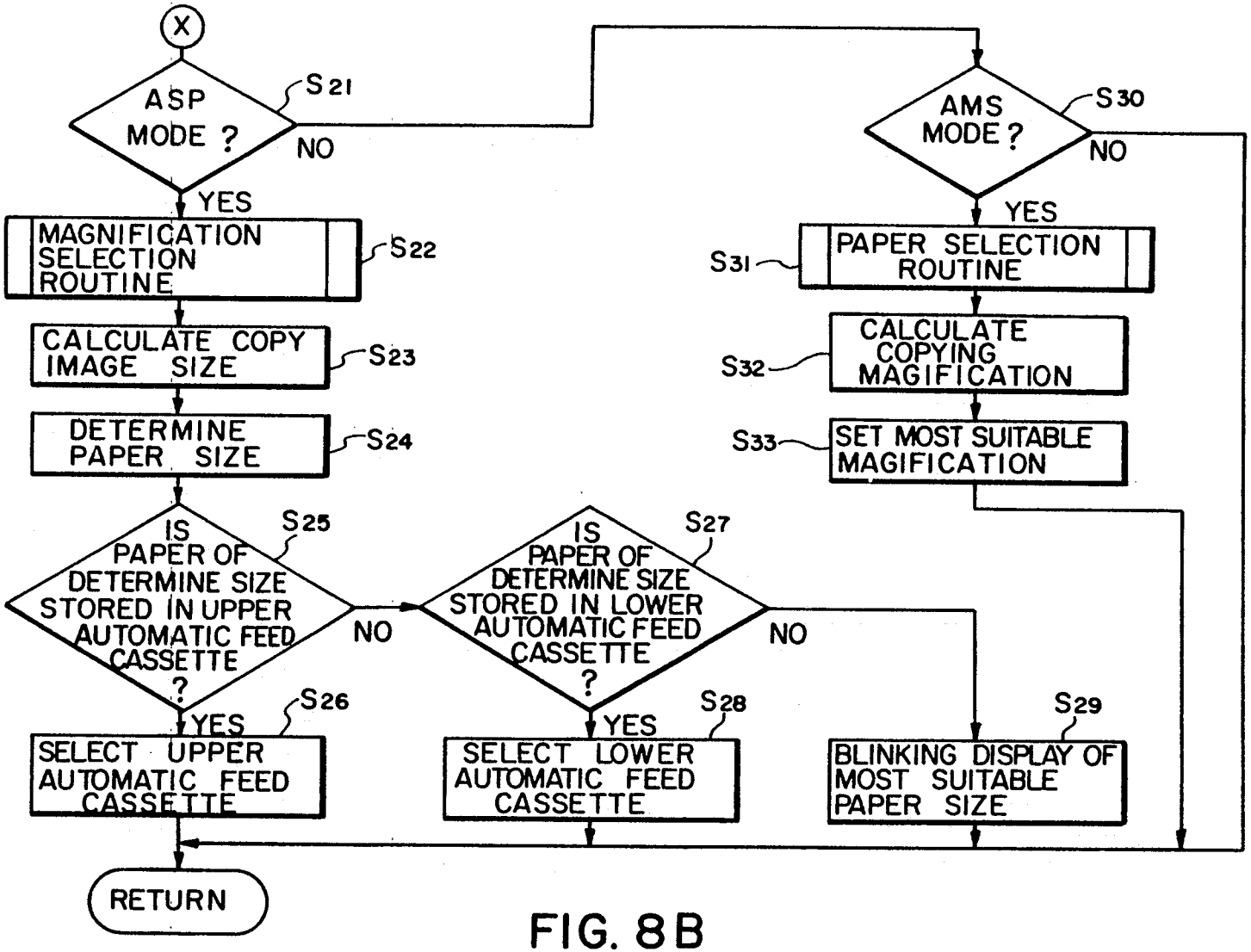

FIGS. 8A and 8B are flow charts showing details of the book mode routine in the above mentioned step M4.

In this routine, a size of a book as an original to be copied is designated and the copying magnification is determined, whereby a most suitable size of copy paper is selected, or alternatively, a size of a book as an original to be copied is designated and a size of copy paper is designated, whereby a most suitable copying magnification is selected.

First, in the step S11, determination is made as to a moment at which the book copy mode selection key 100 is just turned on and if the moment of the turn-on of the book mode selection key 100 is not detected, the flow jumps to the step S21. If the moment of the turn-on of the book copy mode selection key 100 is detected, a mode counter for counting "0" to "3" to set a size of an original is incremented by "1" in the step S12. The value of the mode counter is determined in the steps S13, S15 and S17. If the value of the mode counter is "1", the A4-size original boundary display element 103 indicating selection of an A4-size book is turned on in the step S14 and the A4-size is set as a boundary value of two areas in the book copy mode. If the condition in the step S13 is not satisfied, the value of the mode counter is determined in the step S15. If the value of the mode counter is "2", the B5-size original boundary display element 102 indicating selection of a B5-size book is turned on in the step S16 and the B5-size is set as a boundary value of two areas in the book copy mode. If the condition of the step S15 is not satisfied, the value of the mode counter is determined in the step S17 and if the value of the mode counter is "3", the A5-size original boundary display element 101 indicating selection of an A5-size book is turned on in the step S18 and the A5-size is set as the boundary value of two areas in the book copy mode. If it is determined in the step S17 that the value of the mode counter is not "3" (larger than "3" or equal to "0"), the value of the mode counter is cleared in the step S19. Then, in the step S20, all of the A5-size original boundary display element 101, the B5-size original boundary display element 102 and the A4-size original boundary display element 103 are turned off to indicate that the book copy mode is cancelled, whereby the manual mode is set.

Then, in the step S21, it is determined whether the APS display element is turned on and the automatic paper selection function is set by the processing in the automatic mode routine. If the automatic paper selection function is set, the magnification selected by the processing in the magnification selection routine is inputted in the step S22. In the step S23, a size of a copy image is calculated by multiplication of the size of the original indicated by the A5-size original boundary display element 101, the B5-size original boundary display element 102 or the A4-size original boundary display element 103 by the thus obtained magnification. Based on the copy image size obtained in the step S24, the minimum paper size enabling the entire copy image to be obtained without causing any deficiency in the image is determined by using a memory map or by comparisons. In the step S25, it is determined whether paper of a specified size not causing any deficiency determined based on the copy image size is contained in the upper automatic feed cassette 21 or not. If the paper of the specified size is contained in the upper automatic feed cassette 21, the upper automatic feed cassette 21 is selected in the step S26. If it is determined in the step S25 that the paper of the specified size is not contained in the upper automatic feed cassette 21, it is determined in the step S27 whether the paper of the specified size is contained in the lower automatic feed cassette 22. If the paper of the specified size is contained in the lower automatic feed cassette 22, the lower automatic feed cassette 22 is selected in the step S28. If it is determined that the paper of the specified size is not contained in the upper automatic feed cassette 21 nor the lower automatic feed cassette 22, the display element of the paper size to be used, namely, any one of the B4 display element 61, the B5 display element 62, the B5R display element 63, the A3 display element 64, the A4 display element 65 and the A4R display element 66 is caused to blink in the step S29 to indicate that the paper of the specified size is not stored in the upper automatic feed cassette 21 nor the lower automatic feed cassette 22.

On the other hand, if it is determined in the step S21 that the APS display element is turned off and the automatic paper selection function is not set, it is determined whether or not the AMS display element is turned on by the processing in the automatic mode routine and the automatic magnification selection function is set in the step S30. If the automatic magnification selection function is set, the paper size set by the execution of the paper selection routine is read out. The paper size value is divided by the selected one of the size values of the A5-size original boundary display element 101, the B5-size original boundary display element 102 and the A4-size original boundary display element 103 in the step S32, so that a copying magnification is calculated. Then, in the step S33, the optimum copying magnification is set.

Figure 9A:
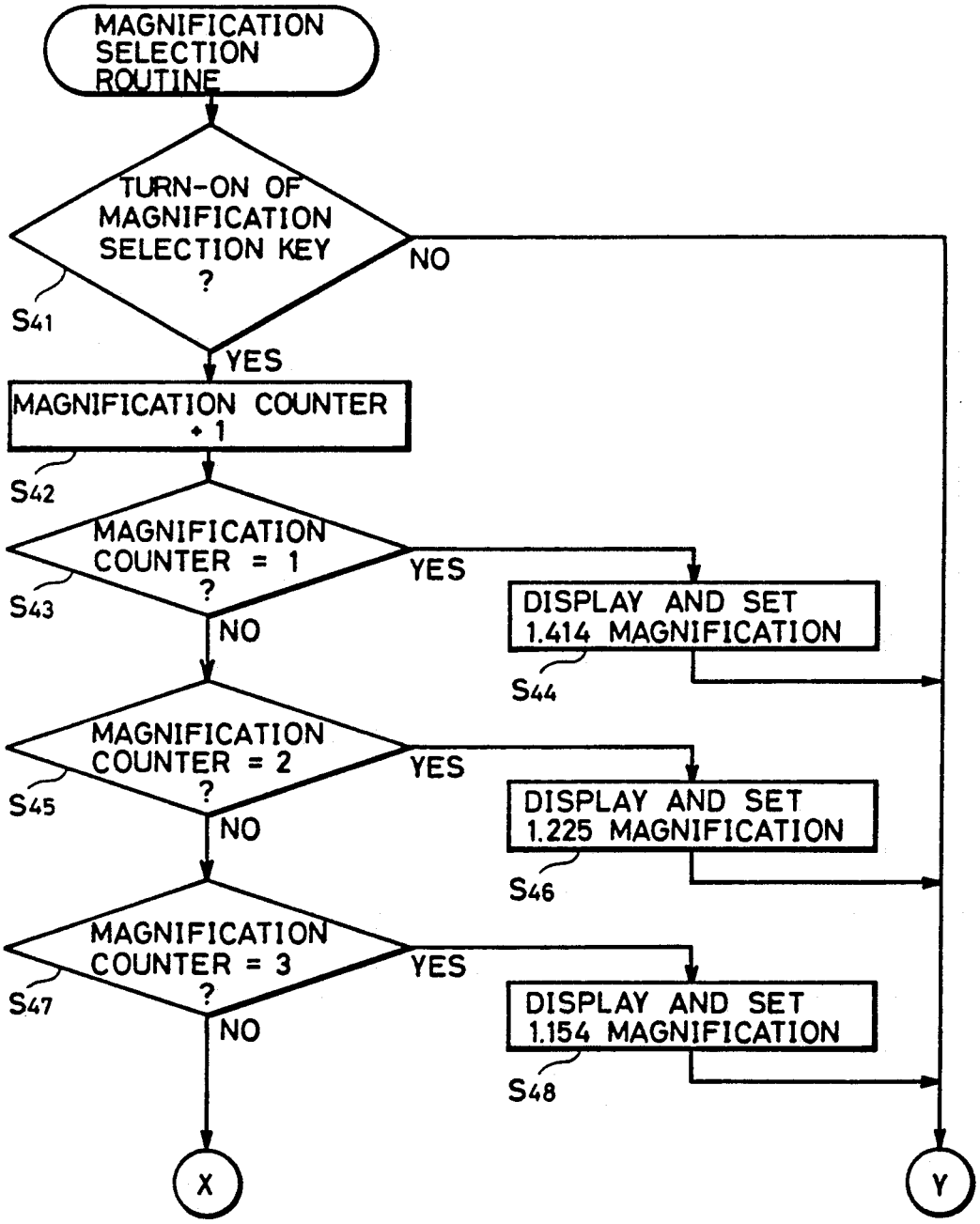
FIGS. 9A and 9B are flow charts showing details of a magnification selection routine included in the flow chart of FIG. 8B.
Figure 9B:
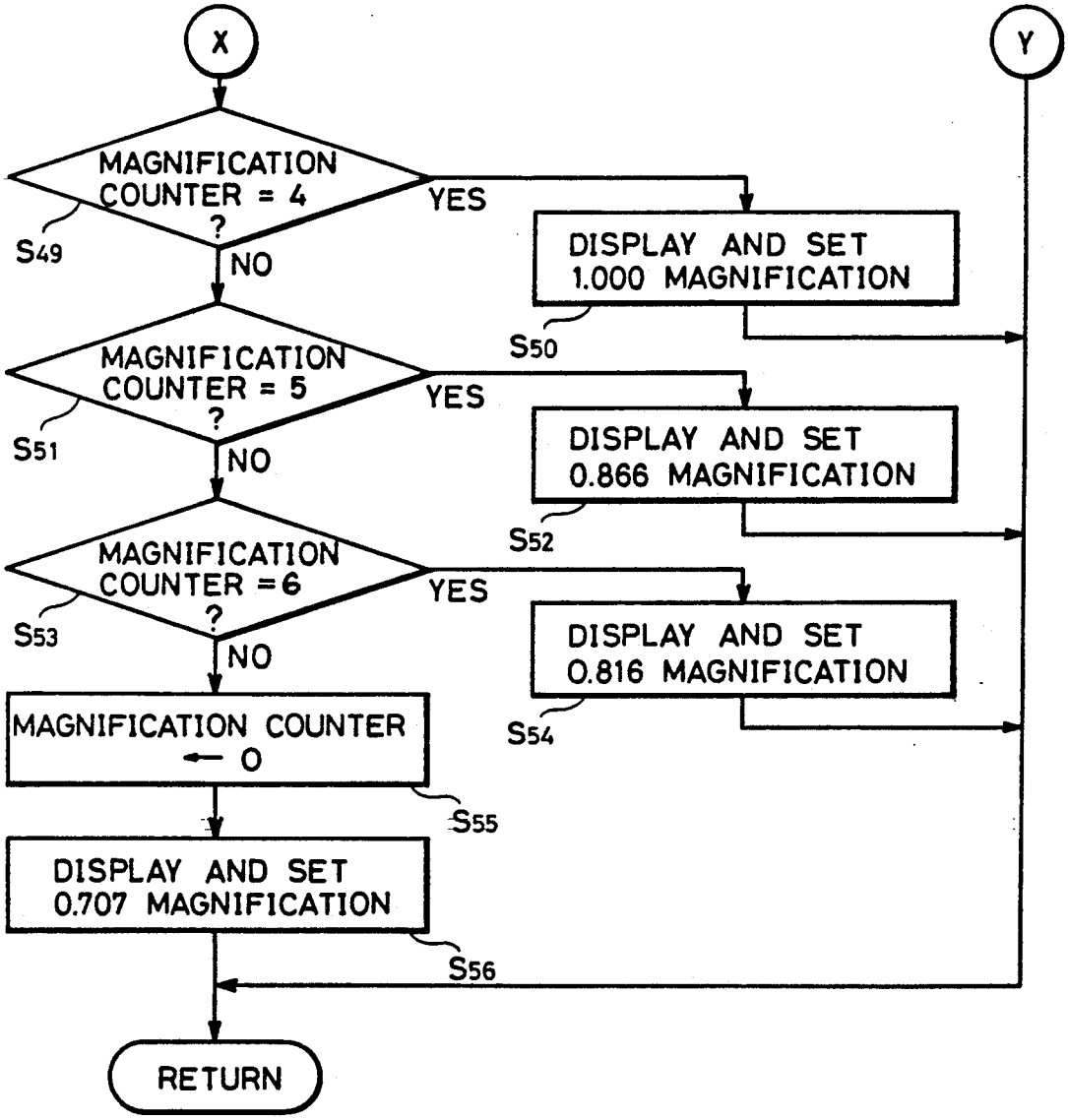

FIGS. 9A and 9B are flow charts of the magnification selection routine used in the book mode routine in FIG. 8B.

In this routine, a specified magnification is set by operation of the magnification selection key 90 in a rotating manner.

First, in the step S41, determination is made as to a moment at which the magnification selection key 90 is just turned on. If the moment of the turn-on of the magnification selection key 90 is not detected, the processing flow exits from this routine. If the moment of the turn-on of the magnification selection key 90 is detected, the magnification counter for counting "0" to "6" is incremented by "1" in the step S42. Then, in the step S43, it is determined whether the value of the magnification counter is "1" or not. If the value of the magnification counter is "1", the 1.414 magnification display element 91 is turned on and the magnification of 1.414 is set in the step S44. It is determined in the step S45 whether the value of the magnification counter is "2" or not. If the value of the magnification counter is "2", the 1.225 magnification display element 92 is turned on and the magnification of 1.225 is set in the step S46. In the same manner, if it is determined in the step S47 that the value of the magnification counter is "3", the 1.154 magnification display element 93 is turned on and the magnification of 1.154 is set in the step S48. If it is determined in the step S49 that the value of the magnification counter is "4", the 1.000 magnification display element 94 is turned on and the magnification of 1.000, i.e., the equal-scale magnification is set in the step S50. If it is determined in the step S51 that the value of the magnification counter is "5", the 0.866 magnification display element 95 is turned on and the magnification of 0.866 is set in the step S52. If it is determined in the step S53 that the value of the magnification counter is "6", the 0.816 magnification display element 96 is set and the magnification of 0.816 is set in the step S54. In the step S55, the magnification counter is cleared and in the step S56, the 0.707 magnification display element 97 is turned on and the magnification of 0.707 is set.

Figure 10A:
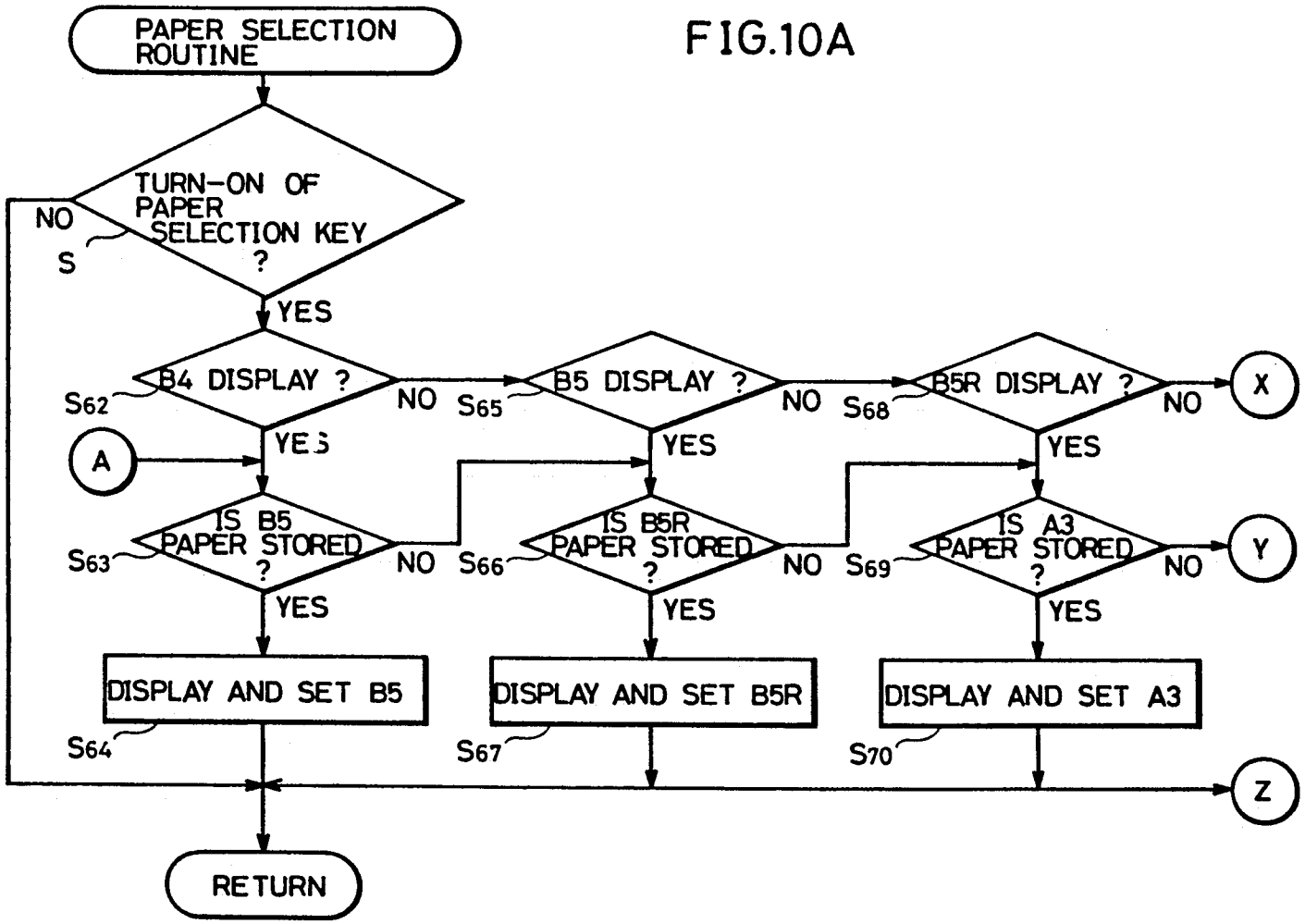
FIGS. 10A and 10B are flow charts showing details of a paper selection routine included in the flow chart of FIG. 8B.
Figure 10B:
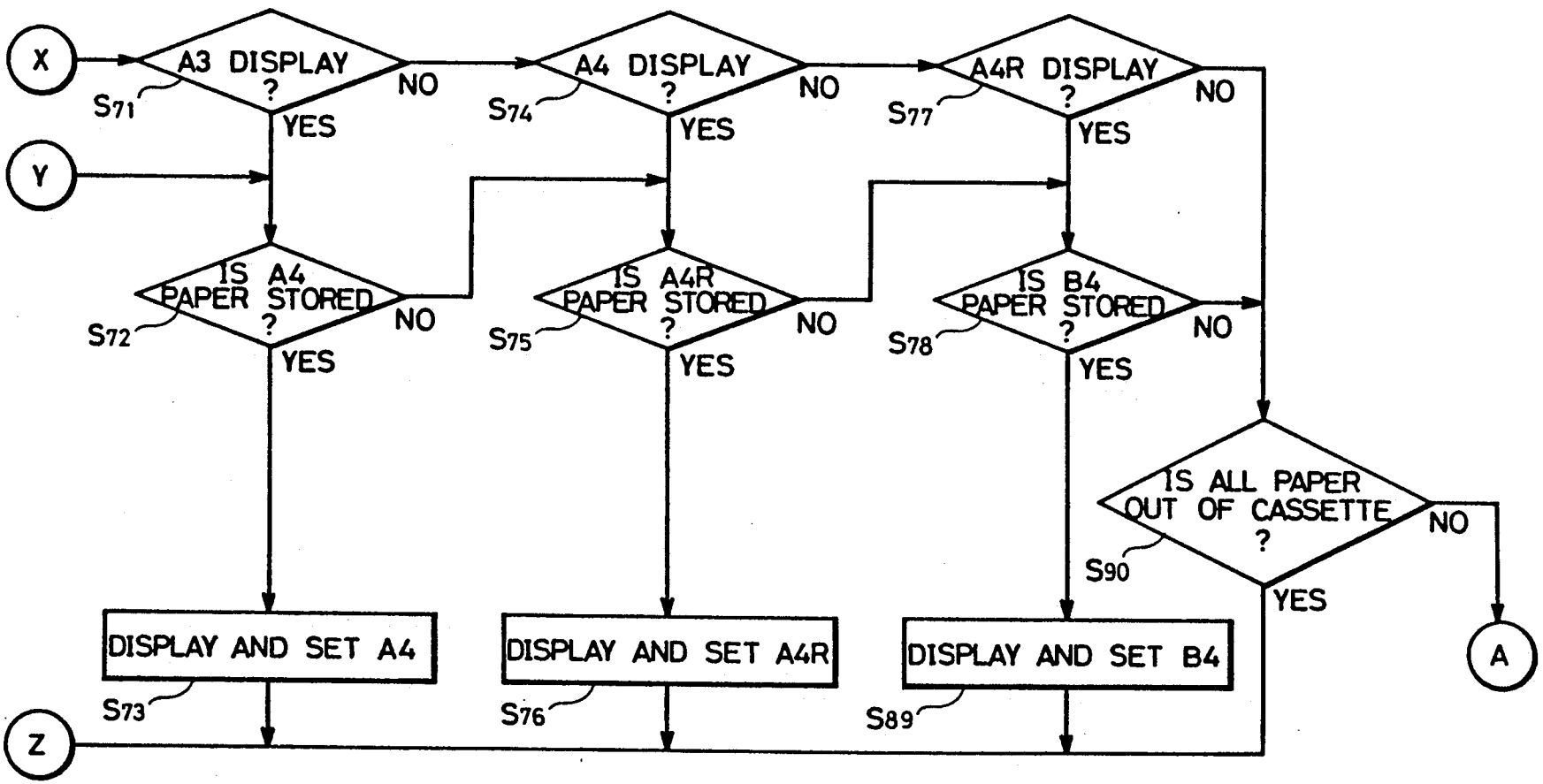

FIGS. 10A and 10B are flow charts of the paper selection routine used in the book mode routine in FIG. 8B.

In this routine, an automatic feed cassette of specified paper is selected by operation of the paper selection key 60. Operation of the paper selection key 60 enables selection of a paper size in the rotating order of B5→B5R→A3→A4→A4R→B4→B5 according to a program. In this embodiment, only two automatic feed cassettes, i.e., the upper automatic feed cassette 21 and the lower automatic feed cassettc 22 are provided and the paper selection in the automatic feed cassette 21 and that in the automatic feed cassette 22 are alternately performed.

In the step S61, determination is made as to a moment at which the paper selection key 60 is just turned on. If the moment of the turn-on signal is not detected, the processing flow returns to the main routine. If the moment of the turn-on signal is detected, it is determined in the step S62 whether the display element currently turned on is the B4 display element or mot, If it is the B4 display element, or if it is not determined in the step S90 that all corresponding papers, that is, all of B5-size paper, B5R-size paper, A3-size paper, A4-size paper, A4R-size paper and B4-size paper are out of cassette, it is determined in the step S63 whether B5-size paper is stored or not. If B5-size paper is stored, the B5 display element is turned on and B5-size paper is set in the step S64. On the other hand, if it is determined in the step S62 that the display element currently turned on is not the B4display element, it is determined in the step S65 whether the display element currently turned on is the B5 display element or not. If it is the B5 display element, or if it is determined in the step S63 that B5-size paper is not stored, it is determined in the step S66 whether B5R-size paper is stored or not. If B5R-size paper is stored, the B5R display element is turned on and B5R-size paper is set in the step S67. In the same manner, in the steps S68 to S89, the display element currently turned on is determined and it is determined whether paper of the specified size is stored in the upper automatic feed cassette 21 or the lower automatic feed cassette 22, so that display of paper size is successively changed. If paper of the specified size is stored, the display element of the specified paper size is turned on and the paper of the specified size is set. Then, if it is determined in the step S90 that any of B5-size paper, B5R-size paper, A3-size paper, A4-size paper, A4R-size paper and B4-size paper is not stored, none of the paper size display elements are turned on and the processing flow exits from this routine.

As described above, display of the paper size is programmed so as to be changed successively in the rotating order of B5→B5R→A3→A4→A4R→B4→B5 each time the paper selection key 60 is pressed, and accordingly if B4-size paper and B5-size paper are stored in the respective cassettes, the paper size display is alternately changed between B4 and B5. If it is determined in the step S90 that none of paper sheets of the above mentioned sizes are stored, the processing flow returns to the main routine.

Thus, after the processing of the automatic mode routine in the step M3 and the book mode routine in the step M4, the copy operation routine is executed in the step M5, whereby copy operation is performed.

The second microcomputer receives signals based on the execution of the copy operation routine to start exposure and scanning operation. Since the exposure and scanning operation by the second microcomputer is well known and does not have a direct relation with the characteristic features of the present invention, a description thereof is omitted.

Although selection of the book copy mode and selection of an original size are effected by a single selection key 100 in the above described embodiment, a plurality of keys may be provided to individually enter boundary size values for the purpose. That is, the book copy mode may be selected as a result of selecting and entering a size of a book, which is displayed. In such a case, display elements indicating the original sizes may be also provided at positions corresponding to the respective sizes in a given direction on the document platen of glass, which makes it easy to confirm each original boundary point.

In addition, although the display means for indicating book sizes are provided in the longitudinal direction on the document platen of glass in the above described embodiment, original boundary marks may be directly provided on the document platen of glass, which makes it easier to ascertain each original boundary point.

Further, although the minimum paper size not causing deficiency in copy image is selected in the book copy mode in the above described embodiment to avoid inefficiency in operation, it is not necessarily needed to select the minimum paper size. Determination of a paper size or a copying magnification may be made based on a paper size sufficiently small to cause no deficiency in copy image. However, the construction as in the above described embodiment, in which the minimum paper size is selected and an alarm is issued if paper of that size is not set in the paper feed sections, contributes to economical use of paper.

As described above, according to the present invention, copy of a desired copying magnification or a desired size can be easily and reliably obtained without causing any deficiency in copy image even in the book copy mode. Consequently, it is not necessary to newly scale up or scale down a reproduction once obtained in the book copy mode as in the prior art and the apparatus of the present invention has advantages not only from an economical point of view but also for maintaining a sharp definition of copy image.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electrophotographic copying apparatus of a slit exposure type, comprising:

a document platen having an original placing area on which an original to be copied is placed, optical scanning means for scanning the original on said document platen and projecting an image of the original, said optical scanning means being capable of changing a projection magnification, paper selection means for selecting a size of paper on which the image of the original is to be formed, paper feed means including a plurality of paper feed sections storing paper sheets of different sizes, for feeding paper sheets of the size selected by said paper selection means from the corresponding one of said paper feed sections, mode selection means for selecting either a normal mode or a division mode, said normal mode being adapted to enable the image of the original on said original placing area to be formed as it is on the paper sheet fed by said paper feed means, and said division mode being adapted to enable said original placing area to be divided into two areas and to enable images of the original on the divided areas to be formed individually on the respective paper sheets fed by said paper feed means, area entry means for entering an area size defined by the division of said original placing area in said division mode, and image forming means for automatically calculating, in said division mode, the projection magnification to be set in said optical scanning means based on the paper size selected by said paper selection means and the area size entered by said area entry means, thereby to execute image formation by using the calculated projection magnification.

2. An electrophotographic copying apparatus in accordance with claim 1, wherein said mode selection means is commonly used for said area entry means.

3. An electrophotographic copying apparatus in accordance with claim 2, wherein said mode selection means comprises:

key input means having a key for selecting said normal mode or said division mode and designating the area size defined by the division in said division mode, and display means for displaying the area size entered by said area entry means.

4. An electrophotographic copying apparatus in accordance with claim 3, wherein said display means comprises a plurality of indicators arranged at positions corresponding to the area sizes defined by the division, along a given direction on said document platen.

5. An electrophotographic copying apparatus in accordance with claim 1, wherein said paper selection means comprises input keys for selecting paper sizes.

6. An electrophotographic copying apparatus of a slit exposure type, comprising:

a document platen having an original placing area on which an original to be copied is placed, copying magnification designation means for designating a copying magnification, optical scanning means for scanning the original on said document platen and projecting an image of the original according to the copying magnification designated by said copying magnification designation means, paper feed means including a plurality of paper feed sections storing paper sheets of different sizes, for feeding paper sheets of a specified size from the corresponding one of said paper feed sections, mode selection means for selecting either a normal mode or a division mode, said normal mode being adapted to enable the image of the original on said original placing area to be formed as it is on the paper sheet fed by said paper feed means, and said division mode being adapted to enable said original placing area to be divided into two areas and to enable images of the original on the divided areas to be formed individually on the respective paper sheets fed by said paper feed means, area designation means for designating an area size defined by the division of said original placing area in said division mode, paper size determination means for automatically determining a size of paper to be fed by said paper feed means in said division mode based on the copying magnification designated by said copying magnification designation means and the area size designated by said area designation means, and image forming means for executing image formation in said division mode by using the paper sheets fed from said paper feed means based on the paper size determined by said paper size determination means.

7. An electrophotographic copying apparatus in accordance with claim 6, wherein said mode selection means is commonly used for said area designation means.

8. An electrophotographic copying apparatus in accordance with claim 7, wherein said mode selection means comprises:

key input means including a key for selecting either said normal mode or said division mode and designating the area size defined by the division in said division mode, and display means for displaying the area size designated by said area designation means.

9. An electrophotographic copying apparatus in accordance with claim 8, wherein said display means comprises a plurality of indicators arranged at positions corresponding to the area sizes defined by the division, along a given direction on said document platen.

10. An electrophotographic copying apparatus in accordance with claim 6, wherein said copying magnification designation means comprises input keys for designating the copying magnification.

11. An electrophotographic copying apparatus of a slit exposure type, comprising:

original placing means having an original placing area on which an original to be copied is placed, scanning means for scanning the original on said original placing area and projecting an image of the original according to a designated copying magnification, paper feed means for storing paper sheets of different sizes and feeding paper sheets of a specified size, mode designation means for designating a division mode, which is adapted to enable said original placing area to be divided into two areas and to enable images of the original on the divided areas to be formed individually on the respective paper sheets fed by said paper feed means, area designation means for designating an area size defined by the division of said original placing area in said division mode, paper size selection means for selecting a size of paper on which the image of the original is to be formed, first image forming means for determining said copying magnification based on the paper size selected by said paper size selection means and the area size designated by said area designation means, thereby to execute image formation, copying magnification designation means for designating said copying magnification, second image forming means for determining a size of paper to be fed from said paper feed means based on the copying magnification designated by said copying magnification designation means and the area size designated by said area designation means, thereby to execute image formation, and enabling means for enabling either said paper size selection means or said copying magnification designation means.

12. An electrophotographic copying apparatus in accordance with claim 11, wherein said mode designation means is commonly used for said area designation means.

13. An electrophotographic copying apparatus in accordance with claim 12, wherein said mode designation means comprises:

key input means including a key for designating said division mode and designating the area size defined by the division in said division mode, and display means for displaying the area size designated by said area designation means.

14. An electrophotographic copying apparatus in accordance with claim 13, wherein said display means comprises a plurality of indicators arranged at positions corresponding to the area sizes defined by the division along a given direction on said original placing area.

15. An electrophotographic copying apparatus in accordance with claim 11, wherein said paper size selection means comprises input keys for selecting the paper size.

16. An electrophotographic copying apparatus in accordance with claim 11, wherein said copying magnification designation means comprises input keys for designating the copying magnification.

* * * * *